US005129333A

United States Patent [19]

Frederick et al.

[11] Patent Number: 5,129,333

[45] Date of Patent: Jul. 14, 1992

[54] APPARATUS AND METHOD FOR RECYCLING WASTE

[75] Inventors: William R. Frederick, Valley View; Don E. Coe, Richmond Hts.; Thomas A. LeBay, Parma; Howard N. Hubert, Bedford, all of Ohio

[73] Assignee: AGA AB, Lidingo, Sweden

[21] Appl. No.: 722,544

[22] Filed: Jun. 24, 1991

[51] Int. Cl.[5] ..... F23G 5/00; F23G 5/12

[52] U.S. Cl. ..... 110/235; 110/238; 110/263; 110/264; 110/346; 431/284

[58] Field of Search ..... 110/264, 238, 346, 235, 110/263; 431/285, 284

[56] References Cited

U.S. PATENT DOCUMENTS

| | | | |
|---|---|---|---|
| 3,643,871 | 2/1972 | Hamernik et al. | 239/419.3 |
| 3,817,685 | 6/1974 | Joannes | 431/116 |
| 3,828,700 | 8/1974 | Ragot | 110/238 |
| 4,094,625 | 6/1978 | Wang et al. | 110/238 X |
| 4,192,488 | 3/1980 | Roeder et al. | 266/77 |
| 4,421,273 | 12/1983 | Lofstrom | 239/8 |
| 4,428,727 | 1/1984 | Deussner et al. | 431/182 |
| 4,531,904 | 7/1985 | Sato et al. | 431/10 |
| 4,628,835 | 12/1986 | Wollner | 110/238 |
| 4,700,637 | 10/1987 | McCartney | 110/238 X |
| 4,785,748 | 11/1988 | Sujata et al. | 110/238 |

FOREIGN PATENT DOCUMENTS

| | | |
|---|---|---|
| 2637050 | 9/1989 | France . |
| 1502413 | 3/1978 | United Kingdom . |

*Primary Examiner*—Edward G. Favors

*Attorney, Agent, or Firm*—Calfee, Halter & Griswold

[57] ABSTRACT

A method and apparatus are provided for reacting waste matter in a flame using fuel such as a flammable gas and oxygen. The apparatus includes a substantially cylindrical burner comprising a burner base and a removably attachable base extension having a diameter greater than that of the base. The base and the base extension each have aligned central nozzles extending their entire lengths for ejecting waste matter to be reacted, and aligned fuel nozzles radially spaced from each of the central nozzles for ejecting fuel to be ignited. The perimeter of the burner base extension is notched to provide channel-shaped peripheral oxygen nozzles. A substantially cylindrical cooling jacket surrounding the burner is adapted to receive oxygen which passes through the space defined by the outer surface of the burner base and the inner surface of the cooling jacket, then through the peripheral oxygen nozzles of the base extension. Other base extensions, having various peripheral nozzle shapes and central nozzle configurations, can be interchangeably attached to the burner base to create desired flow patterns of waste matter and oxygen through the central nozzle and peripheral nozzles, respectively.

23 Claims, 6 Drawing Sheets

APPARATUS AND METHOD FOR RECYCLING WASTE

TECHNICAL FIELD

The present invention relates generally to fuel apparatuses and more specifically to apparatuses adapted to react waste matter in a flame using flammable gas and oxygen.

BACKGROUND OF THE INVENTION

Recycling of waste matter by reacting the waste in a flame is a desirable alternative to permanent storage or burial, especially if the matter to be recycled is environmentally questionable or known to be hazardous. Examples of such waste matter include fiberglass, mineral wool, and industrial solvents. By burning instead of storing or burying the waste matter, the need for landfill space is eliminated. Additionally, the potential health risks associated with future human contact with the waste matter are also eliminated.

Reacting waste matter in a flame envelope, however, introduces concerns regarding by-products of the reaction processes. The reaction of the waste matter in the flame includes many processes, including burning, melting, incineration, combustion, fusion and oxidation. The term "react", or any derivatives thereof, as used herein means one or more of these processes.

Some of these reaction processes yield by-products. For example, reacting waste matter in a natural gas flame, combusting in air which is 80% nitrogen, yields measurable quantities of NO, $N_2O$, and $NO_2$. These are primary components of the so-called "acid rain", or precipitation abnormally high in nitric acid content. Moreover, the temperature of a natural gas flame burning in air can reach only about 3500° F. If the natural gas flame is oxygenated to 100% oxygen with pure oxygen, no nitrous by-products are created by the combustion media, and flame temperatures upwards of 5000° F. can be obtained. The increased flame temperature obtained by oxygenating the flame is advantageous in reacting flame resistant waste matter which requires extremely high temperatures, or oxidizing atmospheres, before reacting in the flame.

Although methods and devices are known for reducing nitrous by-products in gas burners, and for oxygenating gas burner flames to ensure rapid and complete combustion of the gas, it is not known to provide means for directly injecting waste matter mixed with an oxygen-containing gas into an oxygenated flame envelope of a gas burner. For example, Sato, et al. U.S. Pat. No. 4,531,904 discloses an apparatus and a method for reducing the $NO_x$ gas content in the exhaust yielded by a gas burner. Fuel nozzles are disposed intermediate peripheral and central air nozzles. The exit apertures of the peripheral air nozzle and the fuel nozzles are coplanar while the central air nozzle extends beyond this plane. The fuel is primarily burned in the zone near the fuel nozzle and peripheral nozzle apertures, and is secondarily burned in the zone near the central nozzle aperture. The $NO_x$ content of the exhaust gas is minimized by controlling the rate of combustion in these two zones, and by controlling the amount of air supplied to the flame.

Similarly, U.S. Pat. Nos. 3,817,685 to Joannes and 4,428,727 to Deussner, et al. disclose devices designed to ensure complete burning and rapid combustion of fuels provided to the burners. Deussner discloses a multi-level burner adapted to create a turbulent suspension of particles in the primary air stream, creating an aspirating effect for drawing secondary air into the burner along with the turbulent suspension of solid fuel particles t accelerate the combustion process. Joannes discloses a burner wherein fuel is combined with air carried by an air supply pipe, and a shroud element surrounding the air supply pipe creates a region of low pressure which draws the burned gases back into the burning zone to ensure complete combustion. Deussner, Joannes, and Sato, however, all fail to disclose apparatuses or methods for injecting waste matter into a burner flame envelope to ensure rapid and complete reaction of the waste matter.

In addition to reducing the nitrous by-products and increasing the flame temperature of a waste recycling apparatus, it is useful to increase the adaptability of such an apparatus by providing means to cool the apparatus during extended high-temperature use, and by providing apparatus elements which are interchangeable to accommodate reaction of various types of waste. By using interchangeable elements, the rate and pattern of waste, fuel and oxygen injection can be controlled to ensure the proper rate and extent of reaction of a particular waste in the flame.

Although interchangeable burner parts are known, their application is limited to torch heads rather than waste ejecting nozzles. For example, Roeder, et al. U.S. Pat. No. 4,192,488 and French Publication No. 2,637,050 to Rathert disclose such torch heads. Again, as with all of the previously discussed patents, neither of the above two patents having interchangeable torch heads provides a method or apparatus for injecting waste matter directly into a flame envelope to control the rate and degree of reaction of the waste matter in the flame.

Thus, there is a need to provide an apparatus and method for reacting waste matter in an oxygenated flame to ensure rapid and efficient reaction of the waste matter, which is adapted for high temperature application and which has the capability to react a variety of wastes by controlling the rate and extent of reaction of the waste in the flame. The present invention addresses this need.

SUMMARY OF THE INVENTION

According to the present invention, an apparatus and method for recycling waste matter by reacting the waste in an oxygenated flame envelope is provided. The waste recycling apparatus comprises a burner subassembly inserted within a cooling jacket subassembly. The cooling jacket subassembly includes a cylindrical cooling jacket and a cooling jacket extension which in part define an oxygen chamber, and a collar attached to the jacket extension. The extension is provided with an inlet for providing the oxygen chamber with oxygen. The burner subassembly inserted within the cooling jacket subassembly includes a burner having a burner base and an interchangeable base extension attached to the base, and a waste supply conduit and a fuel supply conduit connected to the burner. An end plate attached to the waste and fuel supply conduits closes the oxygen chamber when the burner subassembly is inserted into the cooling jacket subassembly.

The cooling jacket subassembly is adapted to cool the burner during the reaction process by circulating water through an interior portion of the jacket. A pressurized water supply can be connected to the jacket to provide water to the interior. Heat is transferred to the water from the perimeter of the burner base extension which is seated against an inner wall of the cooling jacket.

The cooling jacket extension is welded at one end to the cooling jacket and at the other end to the collar. The collar is provided with holes into which bolts are inserted to connect the burner subassembly to the cooling jacket subassembly. The complete recycling apparatus is formed by inserting the burner subassembly into the cooling jacket subassembly until the end plate abuts the collar, and tightening the bolts. Spacer plates can be inserted intermediate the cooling jacket subassembly collar and the burner subassembly end plate. The spacer plates reduce the extent to which the burner subassembly can be inserted into the cooling jacket subassembly.

The end plate of the burner subassembly is welded to the waste supply conduit and to the fuel supply conduit. The waste supply conduit is axially aligned with a central nozzle in the burner base, and one end of the conduit is inserted within the entire length of the nozzle. The source of waste to be reacted is supplied to the waste supply conduit at the other end. The waste can be fed into the conduit gravitationally, mechanically or pneumatically.

The fuel supply conduit is attached at one end to a baffle chamber in the burner base which communicates with a series of fuel nozzles which are radially spaced from the central nozzle. Fuel, such as natural gas, is supplied to the other end of the conduit. The fuel flows through the supply conduit, through the baffle chamber, and then diverges through the fuel nozzles in the burner base.

The burner of the waste recycling apparatus comprises the burner base and the interchangeable base extension attached thereto. The interchangeable base extension has a central nozzle and radially spaced fuel nozzles corresponding to the burner base central nozzle and fuel nozzles. Additionally, the perimeter of the base extension is notched to create peripheral oxygen nozzles. The peripheral nozzles permit oxygen in the oxygen chamber to pass therethrough.

Various types of interchangeable base extensions can be used with the apparatus. The interchangeable base extensions differ in central nozzle shapes and peripheral nozzle configurations. The various nozzle configurations and shapes are used to create a variety of waste, fuel and oxygen injection rates and patterns depending upon the type of waste matter to be reacted.

Thus, it is an object of the present invention to provide a waste recycling apparatus and method, suitable for high temperature applications, for rapidly and effectively reacting waste matter in a flame emitted by the apparatus.

It is another object of the invention to provide a waste recycling apparatus and method wherein the waste is premixed with oxygen-containing gas prior to reacting with a flame.

It is yet another object of the invention to provide a waste recycling apparatus having interchangeable nozzle extensions for accommodating various types of waste matter to be either partially or totally reacted, wherein the type of nozzle extension selected determines the rate and degree of reaction.

DETAILED DESCRIPTION OF THE PREFERRED EMBODIMENTS

Figures 1, 1A:
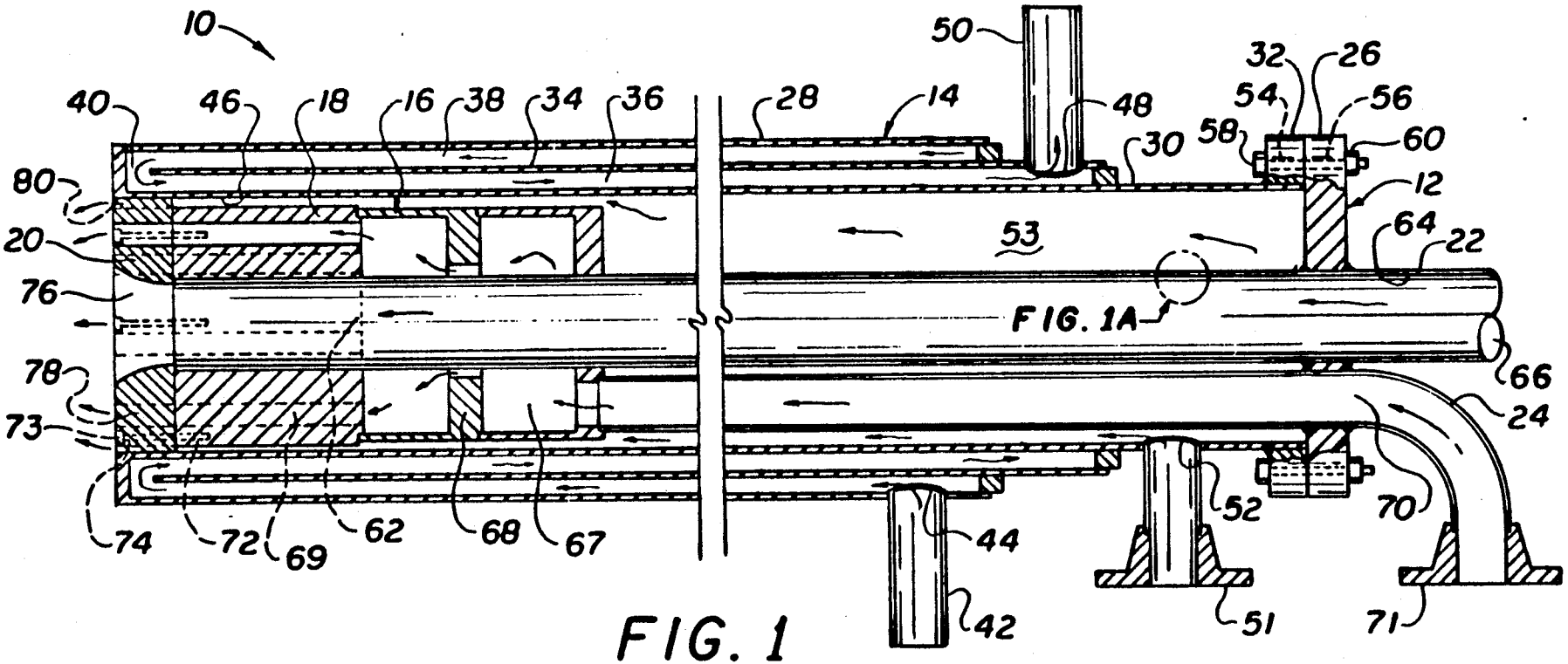
FIG. 1 is a longitudinal sectional view of the waste recycling apparatus constructed according to the principles of the present invention.
FIG. 1A is an enlarged detailed view of the portion of FIG. 1 designated FIG. 1A, shown in section.

Referring now to the drawings, an oxygen-waste recycling apparatus constructed according to the present invention is shown. The apparatus provides means for effectively and efficiently reacting waste matter in a flame envelope using fuel, such as a flammable gas, and oxygen.

FIG. 1 shows a complete waste recycling apparatus indicated generally at 10 comprising a burner subassembly 12 inserted within a cooling jacket subassembly 14. The burner subassembly 12 further comprises a burner 16 having a burner base 18 and an interchangeable base extension 20 attached to the base, a waste supply conduit 22 and a fuel supply conduit 24 attached to the base, and an end plate 26 attached to the conduits 22 and 24. The cooling jacket subassembly 14 further comprises a cooling jacket 28, a cooling jacket extension 30, and a collar 32. The cooling jacket extension 30 is connectable to a source of oxygen to provide oxygen to the interior space of the apparatus defined by the burner 16, the end plate 26 and the cooling jacket subassembly 14.

The cooling jacket subassembly 14 is designed to cool the burner 16 during the reaction process by circulating water through an interior portion of the jacket. In the preferred embodiment, the cooling jacket 28 is a dual chambered structure constructed from stainless steel or other type of corrosion resistant material, such as ceramic, and is shaped in the form of a cylinder. An interior wall 34 which extends substantially the length of the cooling jacket separates the interior of the cooling jacket into an inner compartment 36 and an outer compartment 38. The inner and outer compartments communicate with each other by means of a channel 40 near the burner end of the cooling jacket 28.

A pressurized water supply can be connected to a fitting 42 on an inlet 44 to outer compartment 38 to provide the interior of jacket 28 with water. Heat is transferred to the water from the perimeter of the burner base extension 20 which is seated against an inner wall 46 of the cooling jacket subassembly. The temperature of the water increases as the water flows from outer compartment 38 through channel 40 to inner compartment 36. An outlet 48 having a fitting 50 is provided in the inner compartment 36 to permit the heated water to exit the cooling jacket 28. In this manner, heat generated by the burner 16 can be dissipated during the burning process by the water flowing through the cooling jacket 28.

The cooling jacket extension 30 is attached at one end to the cooling jacket 28 and at the other end to collar 32, preferably by welding. Like the cooling jacket, the extension 30 and the collar 32 in the preferred embodiment are cylindrical in shape and are constructed from stainless steel or ceramic to minimize corrosion and oxidation. Oxygen is supplied to a fitting 51 on an inlet 52 to the jacket extension 30 to provide oxygen to an oxygen chamber 53 defined in part by the inner wall 46 of the jacket subassembly 14 and the end plate 26 of the burner subassembly 12. The collar 32 has evenly spaced holes 54 around its perimeter which provide means to connect the burner subassembly 12 to the cooling jacket subassembly 14.

Formation of the recycling apparatus 10 of the present invention is completed by inserting the burner subassembly 12 into the cooling jacket subassembly 14 until end plate 26 abuts collar 32. The perimeter of the end piece 26 has evenly spaced holes 56 therein which align with the holes 54 in the collar. Bolts 58 inserted through holes 54 and 56 and nuts 60 screwed thereon are used to attach collar 32 to end plate 26, thereby securing the burner subassembly 12 within the cooling jacket subassembly 14. With the end plate 26 abutting the collar 32, as shown in FIG. 1, the burner is situated within the cooling jacket subassembly so that the ends of the base extension 20 and the cooling jacket 28 opposite the end plate are coplanar. As will be discussed later, the shape of the flame envelope emitted by the burner 16 can be varied by withdrawing the burner 16 into the cooling jacket 28 using spacers intermediate the collar 32 and the end plate 26.

The end plate 26 of the burner subassembly 12 is welded to the waste supply conduit 22 and to the fuel supply conduit 24. The waste supply conduit, preferably constructed from tubular stainless steel, although other corrosion resistant material may be used, is axially aligned with a central nozzle 62 in the burner base 18, and inserted within the entire length of nozzle 62. As shown in FIG. 1A, if particularly abrasive wastes are to be burned, a ceramic insert 64 may be inserted into the waste supply conduit 22 in order to prevent damage to the conduit caused by the waste flowing therethrough. Annular rings 65, preferably rubber O-rings, are installed on both ends of the ceramic insert to support and center the ceramic insert within the conduit 22. The rubber O-rings also isolate the ceramic insert from vibration generated during operation of the apparatus.

The source of waste to be reacted is provided to the waste supply conduit at its open end 66. The waste can be fed into the conduit 22 by means of gravity when the apparatus is positioned vertically beneath the source of waste, or it can be mechanically or pneumatically fed into the conduit 22 irrespective of the positioning of the apparatus. In some applications, as will be discussed later, a zone of negative pressure created near the outlet of the central nozzle 62 assists in drawing the waste matter from the source, through the waste supply conduit 22, and into the flame.

The fuel supply conduit is similarly constructed from a corrosion resistant material, such as tubular stainless steel, and is attached at one end to the burner base 18. A baffled chamber 67 in the burner base provided with a baffle plate 68 communicates with a series of substantially parallel fuel nozzles 69 in the burner base. Fuel, such as natural gas, is supplied to an inlet 70 on the other end of the conduit at a fitting 71. Fuel flows through the fuel supply conduit 24, past the baffle plate 68 in the baffle chamber 67, and then diverges through the fuel nozzles 69 prior to exiting the burner.

The burner to which the waste supply conduit and the fuel supply conduit are attached includes both the burner base 18 and the interchangeable base extension 20. The burner base has threaded holes 72 therein adapted to receive threaded screws 73 inserted through holes 74 in the interchangeable base extension. As described above, the burner base 18 has a central nozzle 62 and a plurality of substantially parallel fuel nozzles 69. The interchangeable base extension 20 similarly has a corresponding central nozzle 76 and a plurality of fuel nozzles 78 corresponding to the number of fuel nozzles 69 in the burner base 18. When the base extension 20 is attached to the burner base 18 using the threaded screws 73, the burner base central nozzle 62 is aligned with the base extension central nozzle 76, and the burner base fuel nozzles 69 are aligned with the base extension fuel nozzles 78. In addition, the perimeter of the base extension 20 is notched to create peripheral oxygen nozzles 80. The peripheral nozzles permit oxygen in the portion of the oxygen chamber 53 intermediate the inside wall 46 of the cooling jacket 28 and the burner base 18 to exit the burner.

Figure 2B:
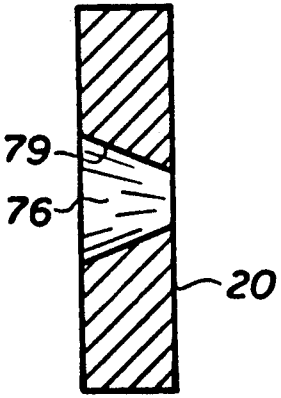
FIGS. 2A–2D are sectional views of a variety of interchangeable burner base extensions of the apparatus of FIG. 1 showing various central nozzle configurations.
Figure 2D:
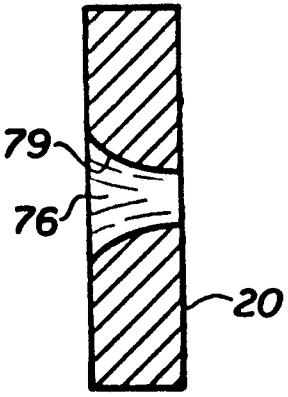
Figure 2A:
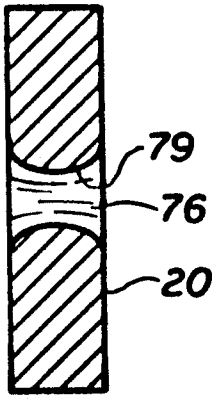
Figure 2C:
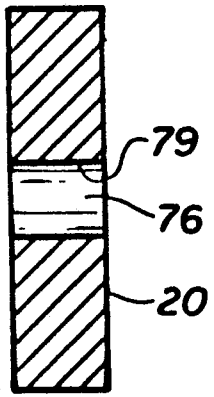

Various types of interchangeable base extensions 20 are shown in FIGS. 2A–D and 3A–D. FIGS. 2A–D illustrate various shapes of inner surfaces 79 of central nozzles, including converging-diverging or Laval (FIG. 2A), frustaconical (FIG. 2B), cylindrical (FIG. 2C) and non-linearly diverging (FIG. 2D). FIGS. 3A-D illustrate various peripheral oxygen nozzle 80 configurations, all of which are notched into the perimeter of the base extension 20. The various central and peripheral nozzle configurations are used to create a variety of flame envelope shapes and burning patterns as will be described later. In addition to being interchangeable, the base extensions 20 can be stacked, thus providing an even greater number of flame envelope shapes and burning patterns.

Figure 4:
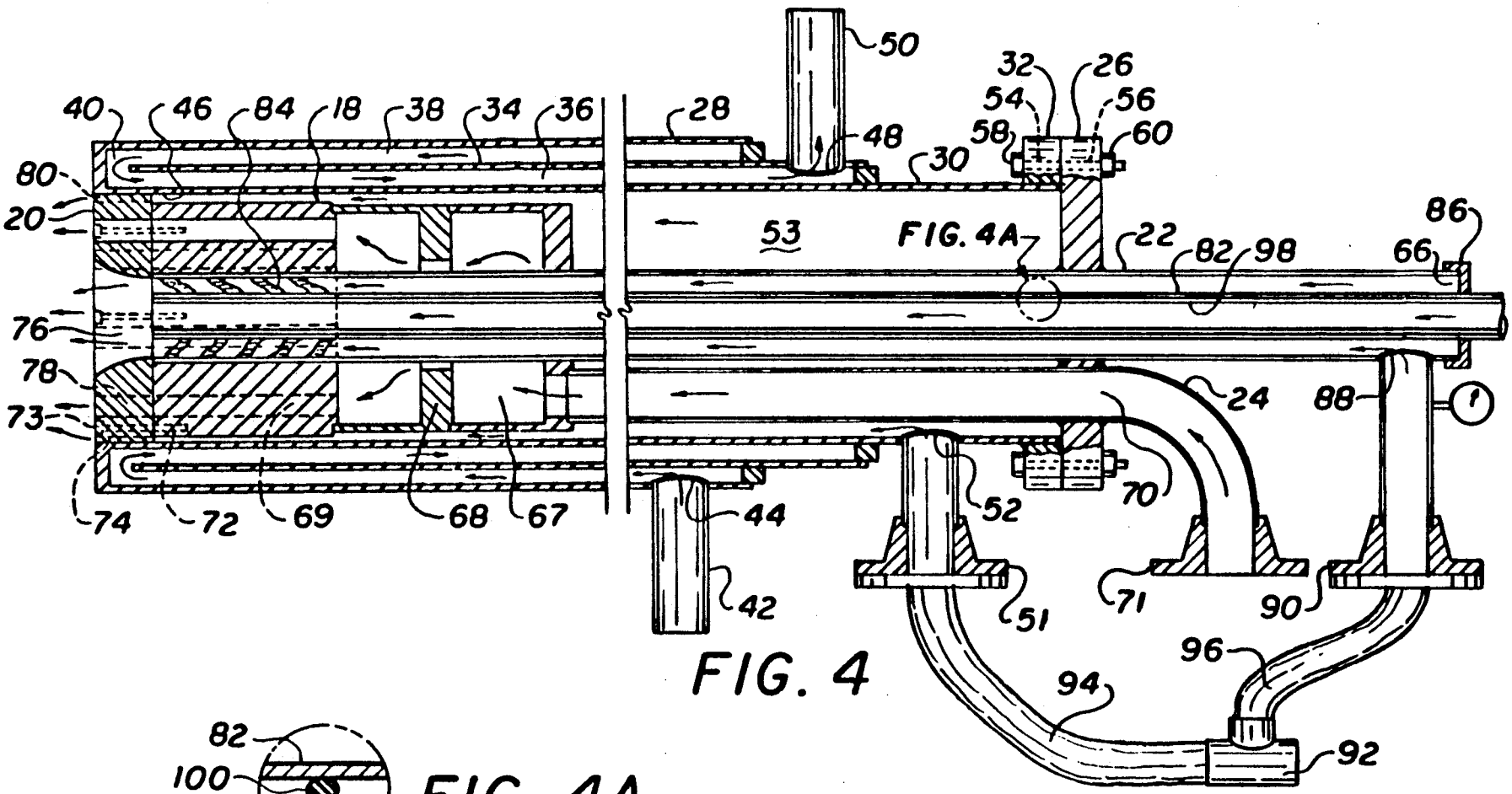
FIG. 4 is a longitudinal sectional view of another embodiment of the waste recycling apparatus constructed according to the principles of the present invention.

FIG. 4 shows another embodiment of the present invention wherein means are provided for mixing the waste matter with oxygen or oxygen-containing gas prior to being reacted. Disposed within and extending running the entire length of the waste supply conduit 22 and the burner base central nozzle 62 is a substantially cylindrical stainless steel inner waste tube 82 having fins 84 on the outer surface of one end and fitted with a compression fitting 86 on the other end. The compression fitting 86 prevents oxygen or oxygen-containing gas from escaping the open end 66 of conduit 22. The fins 84 support and center the inner tube 82 within the waste supply conduit 22. Located on the conduit 22 intermediate the compression fitting 86 and the fins 84 is an inlet 88 having a fitting 90 to which oxygen or oxygen-containing gas is supplied. In this embodiment, a single supply can provide oxygen or oxygen-containing gas to both the oxygen chamber 53 and the space intermediate the waste supply conduit 22 and the inner waste tube 82, by means of a T-connector 92 and flexible tubes 94 and 96.

Figure 4A:
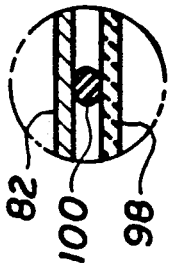
FIG. 4A is an enlarged detailed view of the portion of FIG. 4 designated FIG. 4A, shown in section.
Figure 5A:
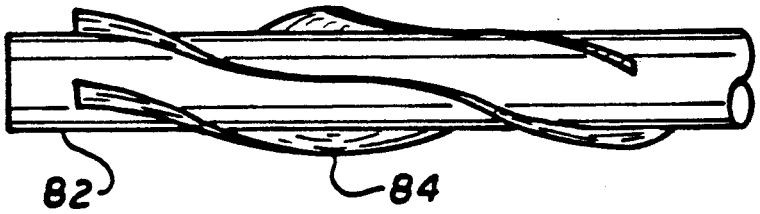
FIGS. 5A–5D are side elevational views of portions of various inner waste tubes used in the embodiment of FIG. 4, showing a variety of fin configurations for directing oxygen flow.
Figure 5B:
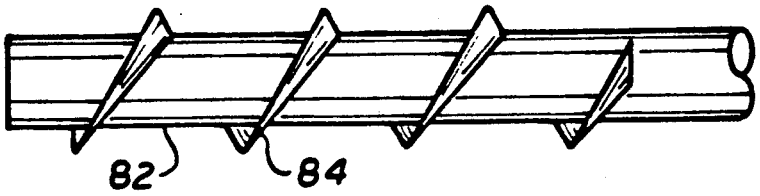
Figure 5C:
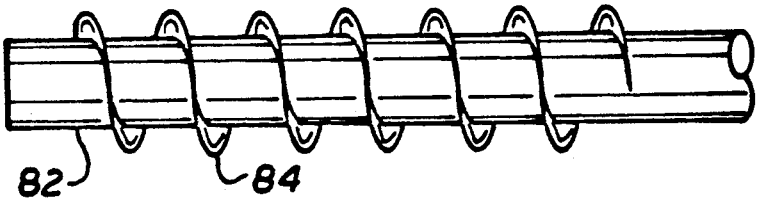
Figure 5D:
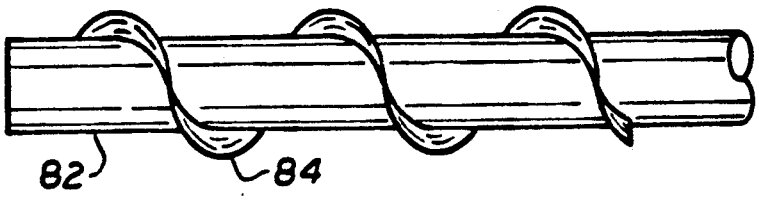

As shown in FIG. 4A, if particularly abrasive waste matter is to be reacted, the inner waste tube 82 can be lined with a ceramic insert 98 to prevent damage caused to the tube by the abrasive waste matter. Annular rings 100, preferably rubber O-rings, are installed on both ends of the ceramic insert 98 to support and center the ceramic insert within the inner tube 82. The rubber O-rings also isolate the ceramic insert from vibration generated during operation of the apparatus.

The fins 84 on the inner waste tube direct the flow of oxygen passing thereover to obtain a desired flow pattern of oxygen which mixes with the waste matter exiting the tube 82. By premixing the waste matter with oxygen prior to reacting, the reaction process is enhanced, minimizing the possibility that waste matter will escape the flame unreacted. Although the fins 84 can be disposed at any angle with respect to the tube 82, the angle is typically set between 10° and 80°. Generally, the larger the angle, the more thorough the mixing of waste matter and oxygen.

Figure 6:
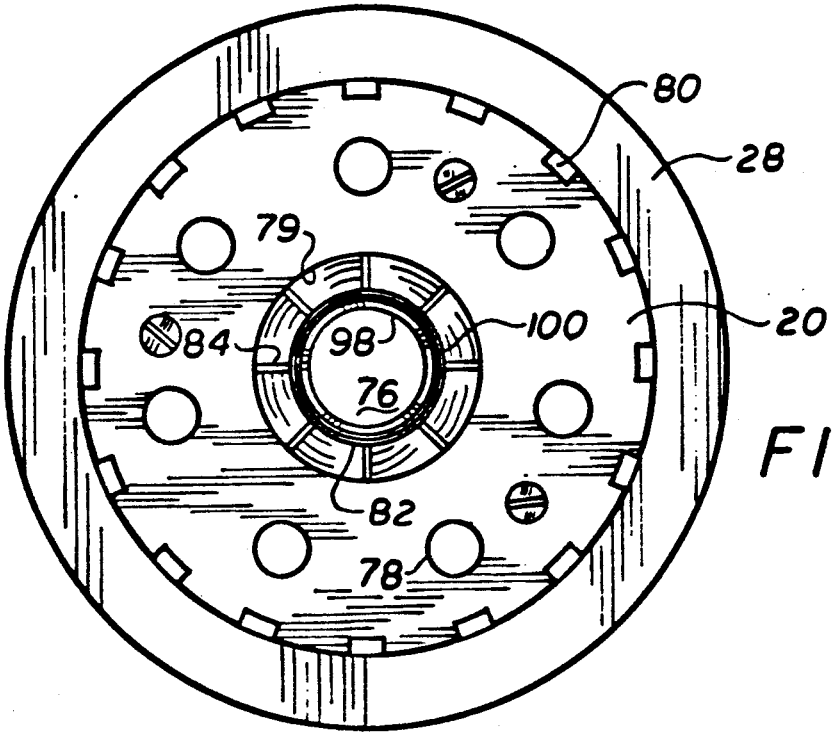
FIG. 6 is an end elevational view of the waste recycling apparatus of FIG. 4.

Various types of fin configurations for the inner waste tube 82 are shown in FIG. 5. Although only four fin configurations are shown, it is contemplated that other configurations may be formed on the inner waste tubes. Because the inner waste tubes are interchangeable within the apparatus, each fin configuration can provide a different flow pattern for the oxygen passing over the fins 84, resulting in various levels of mixing of the oxygen with the waste matter prior to reacting in the burner flame. For matter which is particularly difficult to react a thorough mixing is desired, hence, a tube having a greater number of fins such as that shown in FIG. 5C is utilized. An end elevational view of the burning apparatus of FIG. 4, having a finned inner waste tube 82 disposed within the waste supply conduit 22, is shown in FIG. 6.

Figure 7:
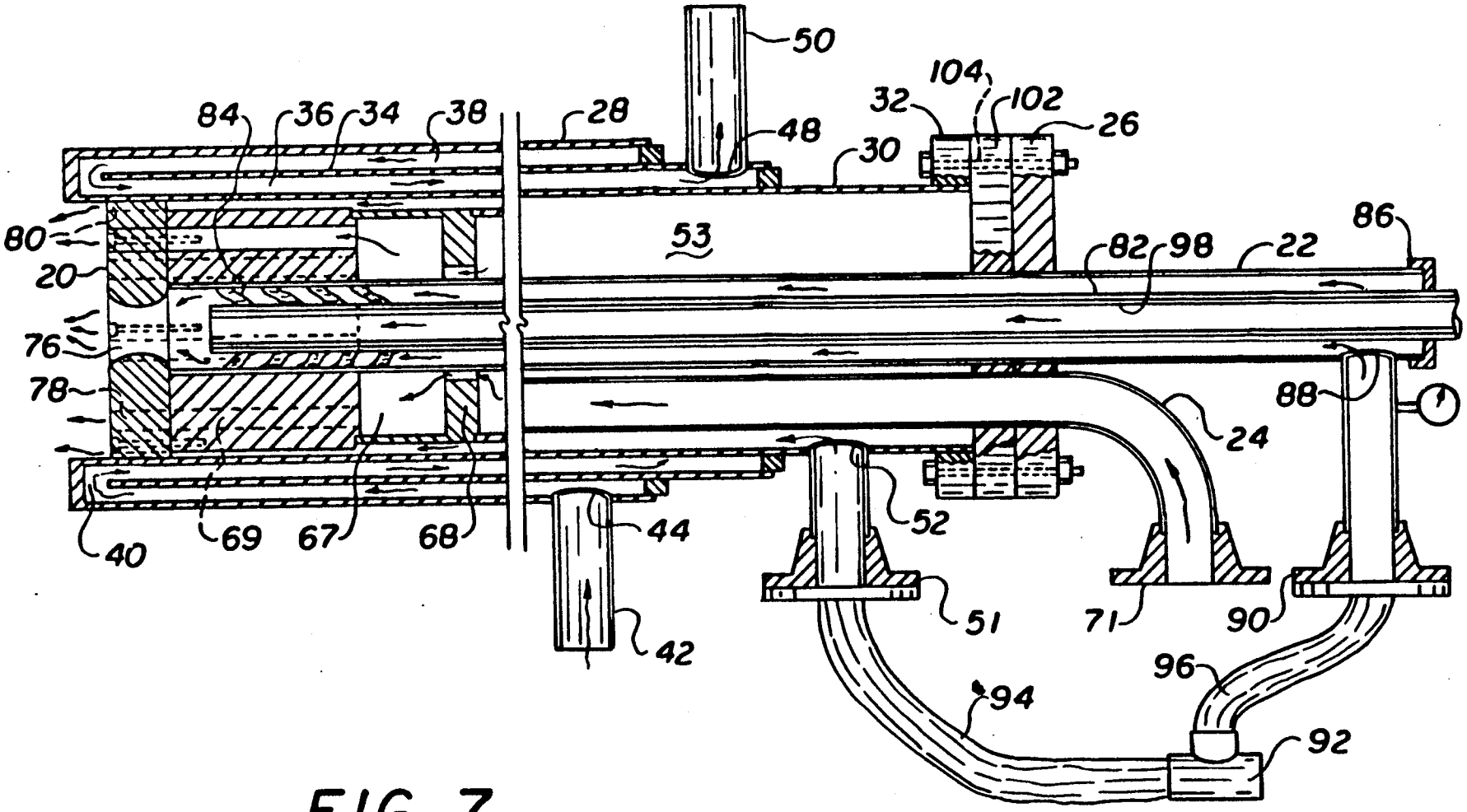
FIG. 7 is a longitudinal sectional view of another embodiment of the waste recycling apparatus according to the present invention.

Another embodiment of the present invention is shown in FIG. 7. The cooling jacket subassembly 14 can be used to vary the shape of the flame envelope emitted by the burner. As shown in FIG. 7, the burner subassembly 12 is not inserted completely into the cooling jacket subassembly 14. Rather, a disk-shaped spacer plate 102 is inserted intermediate the cooling jacket subassembly collar 32 and the burner subassembly end plate 26, preventing the burner 16 from extending to the end of the cooling jacket. Although only a single spacer plate 102 is shown in FIG. 7, it is contemplated that more than one spacer plate may be used with the apparatus, in which case the burner subassembly would be further recessed into the cooling jacket subassembly. The shape of the flame envelope exiting the burning apparatus of FIG. 7 would be confined by the portion of the cooling jacket surrounding the flame, and thus would not expand outwardly as far as a flame emitted by the burning devices shown in FIGS. 1 and 4.

Holes 104 spaced around the perimeter of spacer 102 align with the holes on the perimeters of the collar 32 and the end plate 26. These holes 104 permit the bolts 60 extending therethrough to secure the spacer plate 102 intermediate the collar 32 and the end plate 26. The distance that the cooling jacket 28 extends beyond the end of the interchangeable burner extension 20 equals the width of spacer plate 102 or the sum of the widths of the spacer plates if more than one is used. This distance can be decreased by removing one or more of the spacer plates, or can be increased by inserting additional spacer plates intermediate the collar 32 and the end plate 26.

Figure 8:
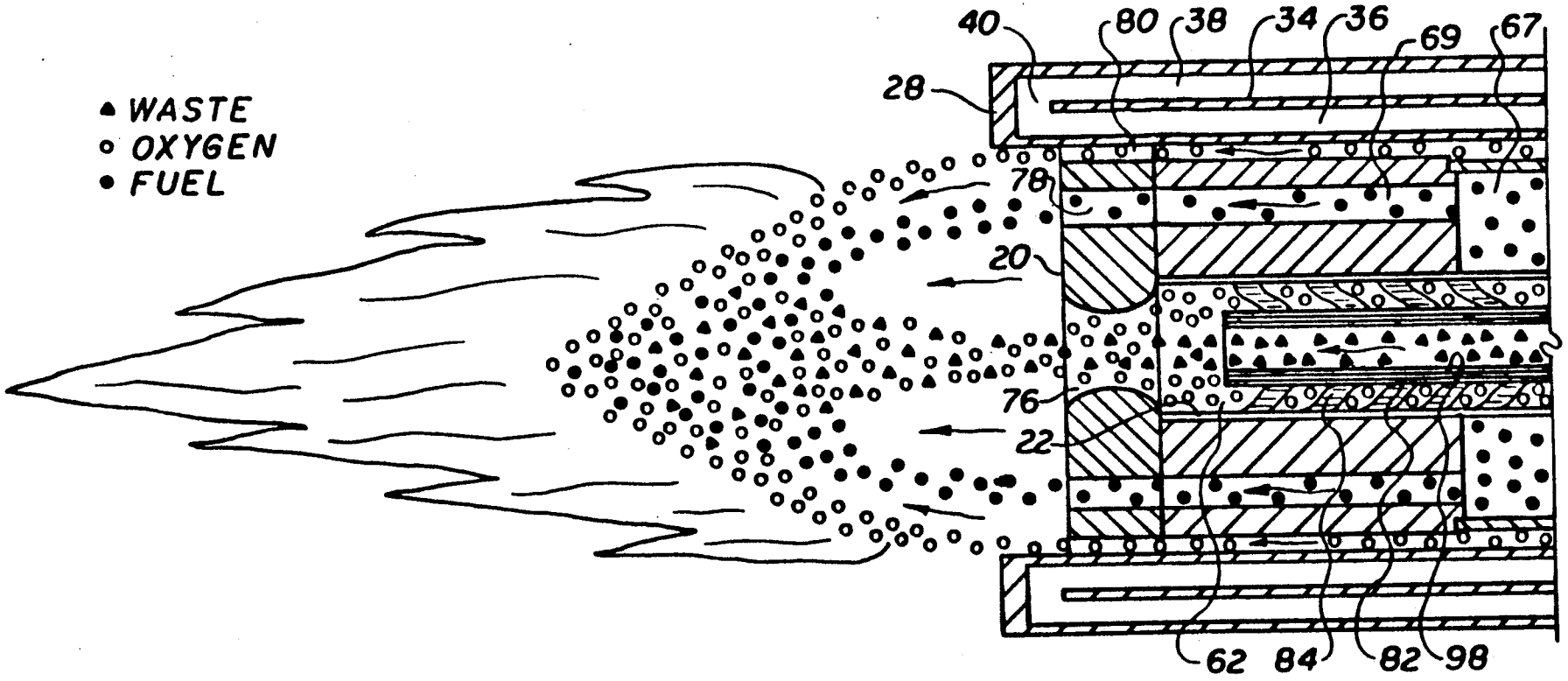
FIG. 8 shows one example of a flame envelope/waste mixture pattern obtainable by a particular embodiment of the present invention.

FIG. 8 shows a particular flame pattern and waste-oxygen mixture obtained using the preferred apparatus of FIG. 7. It should be emphasized that FIG. 8 merely shows one out of an unlimited number of flame/waste-oxygen patterns obtainable by using various fin configurations on the inner waste tube, by changing the interchangeable burner base extensions, and by varying the extent to which the inner waste tube is disposed within the burner central nozzle. As illustrated by FIG. 8, the finned inner waste tube 82 is recessed within the burner base central nozzle 62 about ¾". Spiral fins 84 disposed at a 45° angle with respect to the inner waste tube create a vortex of oxygen which mixes with the waste near the exit of the tube in the area defined by the base extension central nozzle 76. The burner base extension 20 used in the device of FIG. 8 is that shown in FIG. 2A, which has a converging-diverging, or Laval-type central nozzle. The Laval-type central nozzle creates an area of negative pressure just outside the inner waste tube exit which aids in drawing waste matter out of the tube and into the oxygen vortex.

Figure 3B:
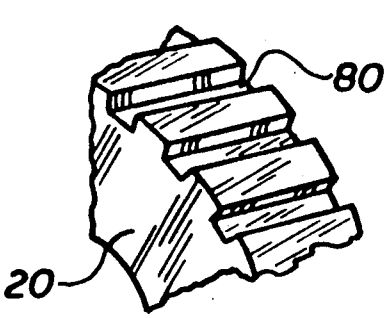
FIGS. 3A–3D are fragmentary perspective views of a variety of interchangeable burner base extensions, showing various peripheral oxygen nozzle configurations.
Figure 3D:
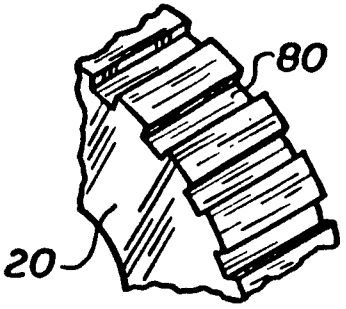
Figure 3A:
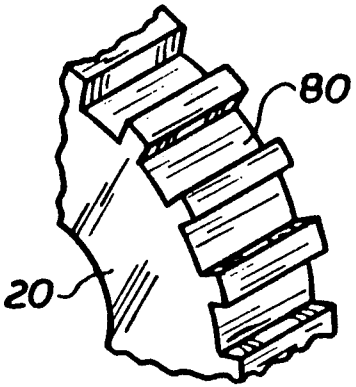
Figure 3C:
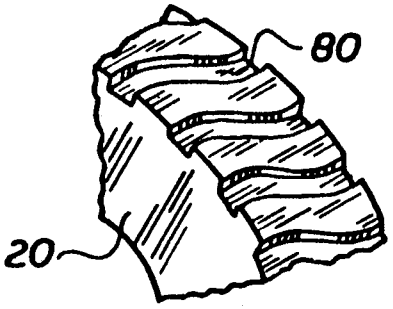

The peripheral oxygen nozzles 80 on the base extension of FIG. 8 are similar to those shown in either FIGS. 3A or 3D. By using this type of straight nozzle in conjunction with the burner recessed within the cooling jacket, the peripheral oxygen flow prevents the flame from expanding outwardly, effectively lengthening the flame and containing the waste/oxygen mixture within the flame envelope to insure complete reaction. Using the arrangement of FIG. 8, a flame having a turbulent core of oxygen, waste matter, and natural gas is produced. The turbulent core is enclosed within an outer skin of high speed oxygen. The flame so produced is self mixing and self feeding.

Accordingly, the preferred embodiment of an apparatus for reacting waste using oxygen and a flammable gas has been described. However, with the present disclosure in mind, it is believed that obvious alternatives to this preferred embodiment, to achieve comparable advantages in other waste recycling apparatuses, will become apparent to those of ordinary skill in the art.

What is claimed is:

1. An apparatus for reacting waste matter in a flame comprising:

a substantially cylindrical burner having an inlet end and an outlet end, a central nozzle extending the entire length thereof for ejecting waste to be reacted in a flame emitted by said burner, a plurality of cylindrical fuel nozzles radially spaced from the central waste ejecting nozzle, and a plurality of peripheral oxygen nozzles located at a greater distance from the central nozzle than the cylindrical fuel nozzles, said plurality of cylindrical fuel nozzles being disposed parallel to said peripheral oxygen nozzles and having discharge openings located in the same plane as discharge openings in said plurality of peripheral oxygen nozzles;

means for supplying waste to said central nozzle;

means for supplying fuel to said cylindrical fuel nozzles;

an enclosure surrounding said cylindrical burner, said means for supplying waste, and said means for supplying fuel; and means for supplying oxygen to the interior of said enclosure.

2. The apparatus of claim 1, wherein said waste supplying means comprises a central conduit aligned with and attached at one end of said central nozzle and at the other end to a source of waste, and wherein said fuel supplying means comprises a conduit attached at one end to said fuel nozzles and at the other end to a source of fuel.

3. The apparatus of claim 1, wherein each of said fuel nozzles is spaced radially equal distances from said central nozzle and said fuel nozzles are spaced circumferentially equal distances from each other.

4. An apparatus for reacting waste matter in a flame comprising:

a substantially cylindrical burner having an inlet end and an outlet end, a central nozzle extending the entire length thereof for ejecting waste to be reacted in a flame emitted by said burner, at least one fuel nozzle radially spaced form the central nozzle, and a plurality of peripheral oxygen nozzles located at a greater distance from the central nozzle than the fuel nozzle;

means for supplying waste, and oxygen or oxygen-containing gas, to said central nozzle;

means for supplying fuel to said fuel nozzle;

an enclosure surrounding said cylindrical burner, said means for supplying waste, and said means for supplying fuel; and means for supplying oxygen to the interior of said enclosure.

5. The apparatus of claim 4, further comprising a tube disposed at least partially within and spaced from an inner surface of the central nozzle, said tube adapted to be connected to a source of waste matter to be reacting, and said means to supply oxygen or oxygen-containing gas to said central nozzle adapted to provide oxygen to the space defined by an outer surface of said tube and said inner surface of said central nozzle.

6. The apparatus of claim 5, further comprising a ceramic insert disposed within said tube.

7. The apparatus of claim 5, wherein the portion of said outer surface of said tube disposed within said central nozzle has extending outwardly therefrom fins for directing the flow of oxygen or oxygen-containing gas which passes thereover.

8. The apparatus of claim 7, wherein the angle formed between one of said fins and said outer surface of said tube is between 10° and 80°.

9. The apparatus of claim 5, wherein said substantially cylindrical burner comprises a burner base and at least one removably attachable base extension having a diameter greater than that of the base, said base and said base extension each having aligned central nozzles extending the respective lengths thereof, and aligned fuel nozzles radially spaced from each of the respective central nozzles, the perimeter of said base extension having notches cut therein, wherein said enclosure is adjacent to the outer surface of said base extension and spaced from said burner base.

10. The apparatus of claim 9, wherein the depth of said notches in the perimeter of said base extension equals the difference in diameters of said burner base and said base extension.

11. The apparatus of claim 9, wherein said central nozzle in said base extension is diverging.

12. The apparatus of claim 9, wherein said central nozzle in said base extension is frustaconical in shape.

13. The apparatus of claim 9, wherein said central nozzle in said base extension is in the shape of a Laval nozzle.

14. The apparatus of claim 9, wherein said notches cut into said perimeter of said base extension are transverse to the longitudinal axis of said substantially cylindrical burner.

15. The apparatus of claim 9, wherein said enclosure comprises a double-walled jacket and means with which to circulate water through the space defined by the two walls.

16. The apparatus of claim 9, wherein said enclosure extends beyond said outlet end of said substantially cylindrical burner.

17. The apparatus of claim 7, wherein said finned tube extends only partially through said central nozzle.

18. The apparatus of claim 9, wherein threaded screws are used to attach said base extension to said base.

19. The apparatus of claim 7, wherein said burner is made of brass and said enclosure, said fuel supplying conduit, said waste supplying conduit, and said tube are made of stainless steel.

20. The apparatus of claim 9, wherein said central nozzle and said fuel nozzles within said base extension are substantially parallel to each other.

21. A method of reacting waste matter in a flame, comprising the steps of:

ejecting fuel from at least one nozzle;

surrounding said ejected fuel with oxygen to promote rapid high temperature burning of said fuel;

mixing waste matter with oxygen or oxygen-containing gas; and ejecting said waste matter mixed with oxygen or oxygen-containing gas directly into a flame envelope created when aid fuel surrounded by said oxygen is ignited.

22. The method of claim 21, wherein said fuel is natural gas.

23. The method of claim 21, wherein said oxygen surrounding the fuel and said oxygen or oxygen-containing gas mixed with the waste matter are provided from the same supply.

* * * * *

UNITED STATES PATENT AND TRADEMARK OFFICE

CERTIFICATE OF CORRECTION

PATENT NO. : 5,129,333

DATED : July 14, 1992

INVENTOR(S) : Frederick, et al.

It is certified that error appears in the above-identified patent and that said Letters Patent is hereby corrected as shown below:

Item [57] ABSTRACT:

In the second to last line, delete "nozle" and insert -- nozzle --.

Column 9, line 25, delete "form" and insert -- from --.

Column 10, line 51, delete "aid" and insert -- said --.

Signed and Sealed this

Fourteenth Day of September, 1993

Bruce Lehman

*Attest:*

BRUCE LEHMAN

*Attesting Officer*

*Commissioner of Patents and Trademarks*